US006645564B2

(12) United States Patent
Hasegawa et al.

(10) Patent No.: US 6,645,564 B2
(45) Date of Patent: Nov. 11, 2003

(54) METHOD FOR FABRICATING PLATED PRODUCTS

(75) Inventors: Yukitaka Hasegawa, Aichi-ken (JP); Yousuke Maruoka, Aichi-ken (JP); Yasuhiko Ogisu, Aichi-ken (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 0 days.

(21) Appl. No.: 10/090,635

(22) Filed: Mar. 6, 2002

(65) Prior Publication Data

US 2002/0136844 A1 Sep. 26, 2002

(30) Foreign Application Priority Data

Mar. 6, 2001 (JP) ..... 2001-062243

(51) Int. Cl.[7] ..... B05D 1/36; B05D 3/00

(52) U.S. Cl. ..... 427/402; 427/407.1; 427/560; 427/600; 427/162; 427/374.1; 427/374.2; 427/374.3; 427/383.1; 427/398.1; 427/404; 427/409; 427/430.1; 427/327; 427/318; 427/309

(58) Field of Search ..... 427/402, 407.1, 427/560, 600, 162, 374.1, 374.2, 374.3, 383.1, 398.1, 404, 409, 430.1, 327, 318, 309

(56) References Cited

U.S. PATENT DOCUMENTS 5,837,354 A * 11/1998 Ogisu et al. ..... 428/208
2001/0012563 A1 * 8/2001 Sakai ..... 428/412

FOREIGN PATENT DOCUMENTS

JP 10-309774 11/1998

* cited by examiner

*Primary Examiner*—Michael Barr
(74) *Attorney, Agent, or Firm*—Posz & Bethards, PLC

(57) ABSTRACT

A method for fabricating a plated product with a basecoat layer, a metal plating layer, and a topcoat layer that are formed on a surface of a base is provided. The method includes the step of forming the basecoat layer and the metal plating layer on the surface of the base. The step is followed by subjecting the metal plating layer to a cold heat treatment or an ultrasonic wave treatment, thus forming a microcrack in the metal plating layer. Afterwards, the topcoat layer is formed on the surface of the metal plating layer.

12 Claims, 2 Drawing Sheets

METHOD FOR FABRICATING PLATED PRODUCTS

BACKGROUND OF THE INVENTION

The present invention relates to methods for fabricating a plated product that has a base on which a basecoat layer, a metal plating layer, and a topcoat layer are formed, and, more particularly, to methods for fabricating a plated product that has microcracks formed in a metal plating layer to suppress corrosion development in the metal plating layer, thus maintaining the appearance of the product.

For example, Japanese Laid-Open Patent Publication No. 10-309774 describes a method for fabricating a layered body with a silver plating layer. The layered body includes a base, an undercoat layer, the silver plating layer, and a topcoat layer. The undercoat layer is formed by drying an undercoat agent, or a varinish that contains alkoxy-titanium-ester and at least either a silane coupling agent with epoxy radicals or epoxy resin.

To form the layered body, the undercoat agent is applied to the surface of the base and is dried to obtain the undercoat layer. Subsequently, an aqueous solution of silver is applied to the surface of the undercoat layer and is dried to form the silver plating layer. The topcoat layer is then formed on the surface of the silver plating layer. The method of the aforementioned patent publication is applicable to layered products with various bases such as insulating or conductive bases. Further, as fabricated by this method, the layered body has the silver plating layer and the undercoat layer that are securely bonded together, and the durability of the layered body is improved. That is, the method makes it possible to efficiently and easily fabricate a layered body that has a silver plating layer with an improved property.

However, the layered body does not include a structure for preventing the topcoat layer and the silver plating layer from being corroded. Thus, if a chloride ion ($Cl^-$) from the exterior of the layered body enters the silver plating layer through the topcoat layer, the material of the silver plating layer, or silver, is corroded. Once the corrosion occurs, the corrosion develops to the entire silver plating layer, thus forming visible whitish lines in the silver plating layer. This significantly hampers the appearance of the layered body. The layered body is thus highly unlikely to pass a salt water spraying test or CASS(Cupric chloride, acetic Acid, Salt Spray) Test for estimating anti-corrosion resistance and anti-weather resistance of a plated product used as an ornament.

SUMMARY OF THE INVENTION

Accordingly, to solve the aforementioned problem, it is an objective of the present invention to provide a method for fabricating a plated product that prevents the appearance of the product from being hampered by corrosion of a metal plating layer and passes an anti-corrosion resistance test.

To achieve the foregoing and other objectives and in accordance with the purpose of the present invention, the invention provides a method for fabricating a plated product with a basecoat layer, a metal plating layer, and a topcoat layer that are formed on a surface of a base. The method includes the steps of forming the basecoat layer and the metal plating layer on the surface of the base, forming a microcrack in the metal plating layer by subjecting the metal plating layer to a cold heat treatment or a supersonic wave treatment after the formation of the basecoat layer and the metal plating layer, and forming the topcoat layer on a surface of the metal plating layer.

A further perspective of the present invention is a method for fabricating a plated product with a basecoat layer, a metal plating layer, and a topcoat layer that are formed on a surface of a base formed of synthetic resin. The method includes the step of forming the basecoat layer on the surface of the base. The basecoat layer is obtained by applying a basecoat agent to the surface of the base or immersing the surface of the base in the basecoat agent and then drying the basecoat agent on the surface of the base. The method also includes the step of forming the metal plating layer on the basecoat layer. The metal plating layer is obtained by a chemical silver plating method. The method further includes the steps of forming a microcrack in the metal plating layer by subjecting the metal plating layer to a cold heat treatment or an ultrasonic wave treatment, and forming the topcoat layer on the surface of the metal plating layer.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objectives and advantages thereof, may best be understood by reference to the following description of the presently preferred embodiments together with the accompanying drawings in which:

FIG. 1(*b*) is a perspective view corresponding to FIG. 1(*a*); and

DETAILED DESCRIPTION OF THE PREFERRED EMBODIMENTS

An embodiment of the present invention will now be described with reference to the drawings.

Figure 1:
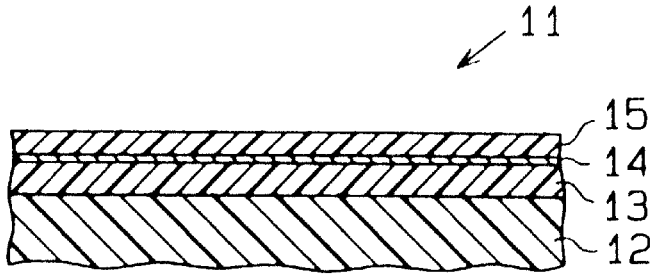
FIG. 1(*a*) is a cross-sectional view schematically showing a portion of a plated product of an embodiment according to the present invention.
Figure 1:
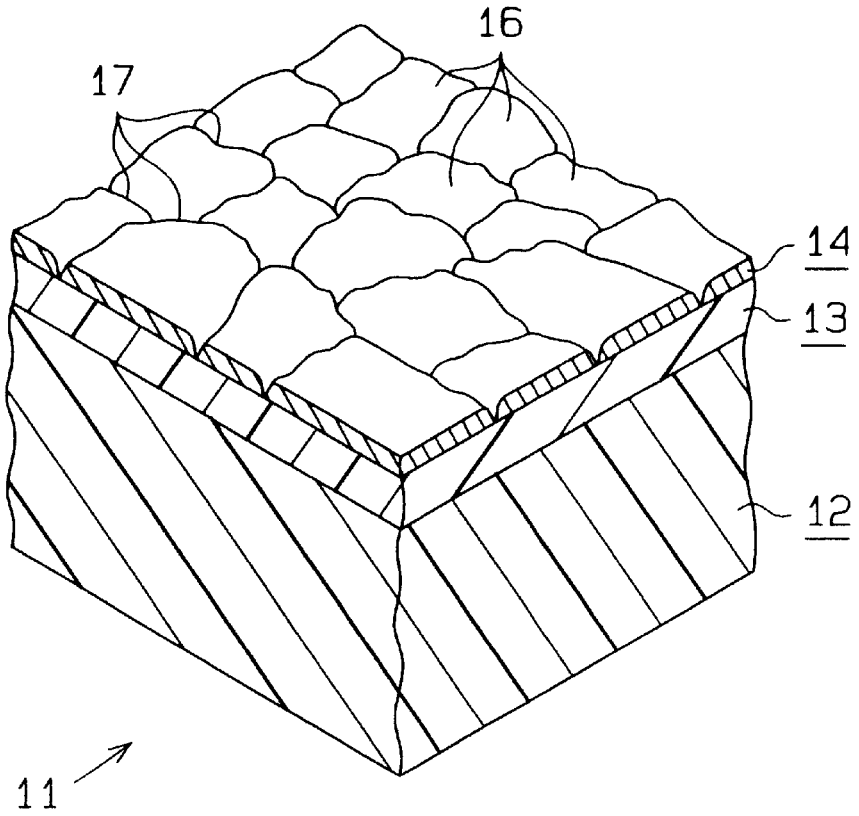

As shown in FIG. 1(*a*), a plated product 11 includes a base 12 formed of synthetic resin. A basecoat (BC) layer 13, a silver plating layer 14, and a topcoat (TC) layer 15 are applied in this order to a surface (a design surface) of the base 12. The silver plating layer 14 is formed by a chemical plating method (electroless deposition) that uses a silver mirror reaction.

The base 12 is formed of acrylonitrile-butadiene-styrene copolymer (ABS), polycarbonate-ABS (PC-ABS) alloy, polypropylene (PP), olefin type thermoplastic elastomer (TPO), polymethyl methacrylate (PMMA), or thermoplastic elastomer (TPE) by a known injection molding method.

To form the basecoat layer 13, a basecoat agent is applied to the surface of the base 12 or the surface of the base 12 is immersed in the basecoat agent. The basecoat agent is then dried to complete the basecoat layer 13. The basecoat agent includes polyester resin, alkyd resin, and acrylic resin. However, since a double-liquid hardened type polyurethane resin is easy to apply, it is preferred that the resin be used as the basecoat agent.

To form the silver plating layer 14, a solution of ammoniacal silver nitrate ($[Ag(NH_3)_2]^+OH^-$) (Tollens reagent) and a reducer solution are applied to a surface of the basecoat layer 13 such that the two solutions are mixed on the surface. This causes an oxidization-reduction reaction, and silver (Ag) is deposited on the surface of the basecoat layer 13 to form the silver plating layer 14. It is preferred that an organic compound with an aldehyde group including glyoxal (R—CHO), sodium sulfite, or sodium thiosulfate be used as the reducer solution. The silver mirror reaction between the ammoniacal silver nitrate solution and the organic compound with the aldehyde group is indicated by the following formula (1):

$$2[Ag(NH_3)_2]^+OH^- + R—CHO \rightarrow 2Ag + R—CO_2NH_4 + H_2O + 3NH_3 \quad (1)$$

Although the silver plating layer 14 is visible as a metal layer, numerous microcracks are formed in the silver plating layer 14. Thus, as microscopically observed, the silver plating layer 14 forms a continuous structure in which numerous fine metal particles 16 with hexagonal or scale-like shapes are put together tightly, as schematically shown in FIG. 1(*b*). In this structure, one side of each metal particle 16 is in contact with or is located close to the corresponding side of the adjacent metal particle 16. The boundary between these sides of the metal particles 16 form a crystalline interface 17.

To form the topcoat layer 15, a topcoat agent is applied to a surface of the silver plating layer 14 or the surface of the silver plating layer 14 is immersed in the topcoat agent. The topcoat agent is then dried to complete the topcoat layer 15. The topcoat agent includes polyester resin and acrylic resin. However, since the double-liquid hardened type polyurethane resin or acrylic modified silicone resin is easy to apply, it is preferred that these resins be used as the topcoat agent. It is further preferred that the topcoat agent contain a chlorine type trapping agent such as an epoxy type additive. The trapping agent traps a chloride ion that enters the topcoat agent 15 from the exterior of the plated product 11 and stops the chloride ion from reaching the silver plating layer 14. This prevents the silver plating layer 14 from being corroded. Further, if the chloride ion is located on the surface of the silver plating layer 14, the trapping agent traps the chloride ion, thus suppressing development of corrosion.

A method for fabricating the plated product 11 will now be described.

Figure 2:
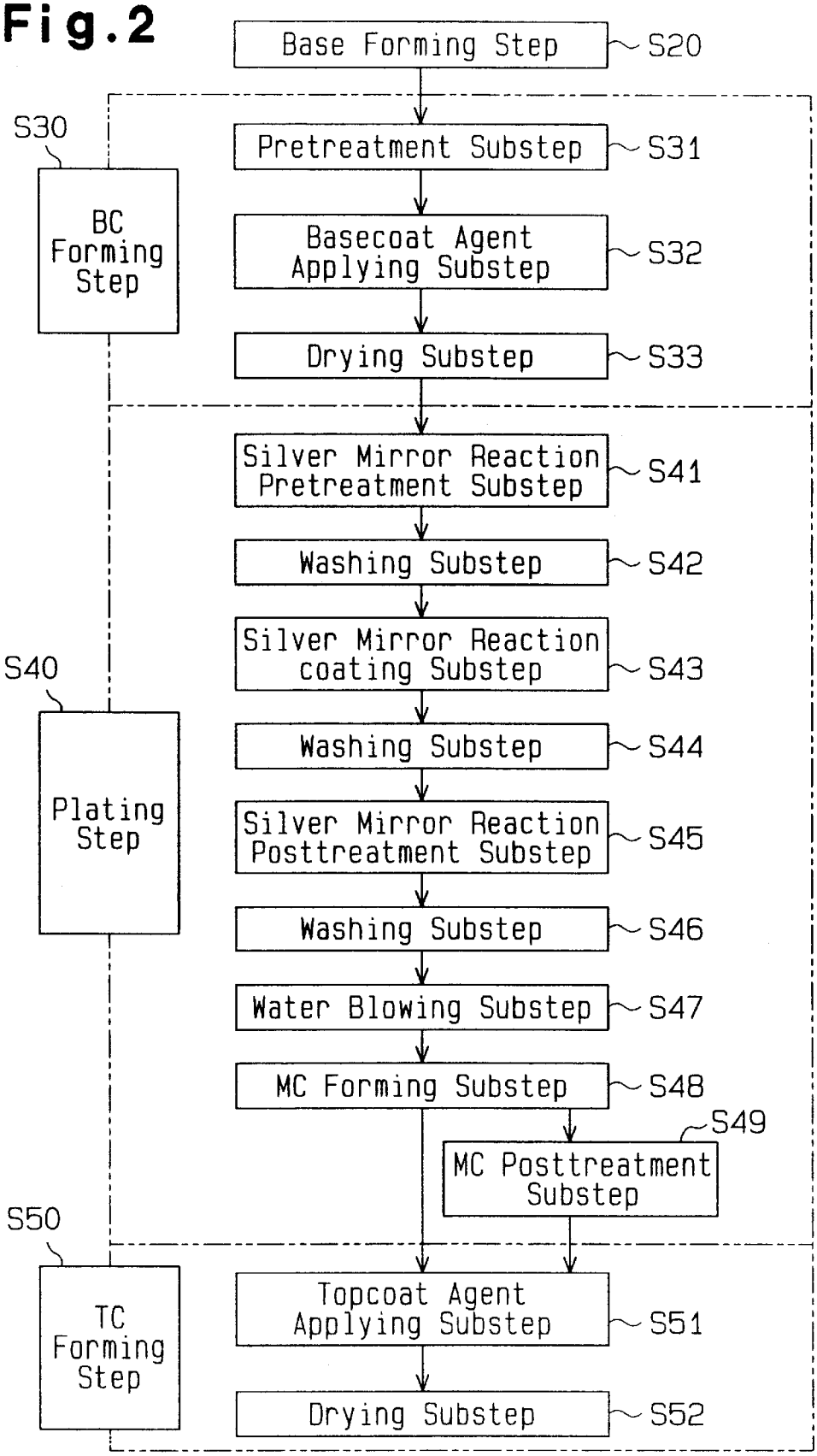
FIG. 2 is a flowchart showing a method for fabricating the plated product of the embodiment.

First, as shown in FIG. 2, the base 12 is formed in a predetermined shape through injection molding in step S20. A basecoat forming step (a BC forming step) S30 is then conducted.

In the step S30, the basecoat layer 13 is formed on the surface of the complete base 12 using the basecoat agent. More specifically, in a pretreatment substep S31, the surface (the design surface) of the base 12 is sufficiently washed with a cleaning agent such as isopropanol. Subsequently, in a basecoat agent applying substep S32, the design surface of the base 12 is uniformly coated with the basecoat agent. The coating may be conducted by applying the basecoat agent on the design surface of the base 12 or immersing the design surface of the base 12 in the basecoat agent. However, since the design surface of the base 12 is easily coated by spraying the basecoat agent on the design surface, it is preferred that the coating be conducted through spraying. Afterwards, in a drying substep S33, the basecoat agent on the design surface of the base 12 is dried at approximately 80 degrees Celsius for about 60 minutes. The method then moves on to a plating step S40.

In the step S40, the silver plating layer 14 is formed on the basecoat layer 13. First, in a silver mirror reaction pretreatment substep S41, a 2–3 weight percent solution of stannic chloride ($SnCl_2$) is applied to the surface of the basecoat layer 13 or the surface of the basecoat layer 13 is immersed in the solution. Tin is thus adsorbed to the surface of the basecoat layer 13. Subsequently, in a washing substep S42, the surface of the basecoat layer 13 is washed with ion exchange water (ion exchange water with electric conductivity of 3 $\mu$S/cm or lower is preferred) or distilled water. Excessive stannic chloride, which remains non-adsorbed, is thus removed. In these substeps S41 and S42, palladium (Pd) may be used instead of tin.

Next, in a silver mirror reaction coating substep S43, an ammoniacal silver nitrate solution and a reducer solution are applied together to the washed surface of the basecoat layer 13. This causes a silver mirror reaction between the solutions such that silver is deposited on the surface of the basecoat layer 13. The solutions may be easily applied to the basecoat layer 13 with a double-headed spray gun or a concentric spray gun. The deposited silver replaces the tin on the surface of the basecoat layer 13 and is adsorbed to and accumulated on the surface of the basecoat layer 13, thus forming the silver plating layer 14. In a subsequent washing step S44, the surface of the silver plating layer 14 is washed with ion exchange water or distilled water to remove excessive solution and tin. The method then moves on to a silver mirror reaction posttreatment substep S45.

Even after the washing substep S44, a trace quantity of impurities may remain adsorbed to the surface of the silver plating layer 14. Particularly, organic byproducts from the silver mirror reaction indicated by the formula (1) such as $NH_3$ or R—$CO_2NH_4$ may remain unwashed on the surface of the silver plating layer 14.

These impurities are modified through natural oxidization by oxygen in the ambient air, thus discoloring the surface of the silver plating layer 14 to an yellowish tone. This significantly hampers the appearance of the plated product 11. Thus, in the substep S45, an appropriate posttreatment is conducted to prevent the impurities from discoloring the silver plating layer 14. The posttreatment may be performed as an impurity disintegrating stage, an impurity adsorbing stage, or an antioxidant film forming stage. In the impurity disintegrating stage, the impurities are disintegrated to be removed from the surface of the silver plating layer 14. In the impurity adsorbing stage, the impurities are adsorbed to be removed from the surface of the silver plating layer 14. In the antioxidant film forming stage, a thin antioxidant film is formed on the surface of the silver plating layer 14.

More specifically, in the impurity disintegrating stage, a low concentration acid is applied to the surface of the silver plating layer 14 or the surface of the silver plating layer 14 is immersed in the acid, thus disintegrating the impurities to remove the impurities from the surface of the silver plating layer 14. It is preferred that the acid be acetic acid or dilute sulfuric acid. It is further preferred that the acid strength of the acid be $1.0\times10^5$ to $1.0\times10^7$ in terms of acid constant Ka, or −7 to 5 in terms of pKa. Also, it is preferred that 3 to 10 weight percent acetic acid or 2 to 6 weight percent dilute sulfuric acid be used. In the subsequent impurity adsorbing stage, a protein dispersed solution is applied to the surface of the silver plating layer 14 or the surface of the silver plating layer 14 is immersed in the solution, thus enabling the protein to adsorb the impurities and remove the impurities from the surface of the silver plating layer 14. The protein dispersed solution includes mammalian milk such as cow milk and powdered milk. However, it is preferred that casein dispersed in water or a low-concentration aqueous alcohol solution as solvent be used as the protein dispersed solution.

In the antioxidant film forming stage, a metal surface treatment agent is applied to the surface of the silver plating layer 14 or the surface of the silver plating layer 14 is immersed in the agent, thus forming a thin antioxidant film on the surface of the silver plating layer 14.

The metal surface treatment agent includes known metal surface treatment agents that are applicable to other metals than silver. The metal surface treatment agent forms a highly water-repellent antioxidant film, as applied to the surface of the silver plating layer 14 or other metal surfaces or metal plated surfaces. If the antioxidant film is formed on the surface of the silver plating layer 14, the film physically inhibits the exposure of the surface of the silver plating layer 14 to the ambient air. The film thus functions as an antioxidant film that prevents the impurities on the surface of the silver plating layer 14 from being naturally oxidized by oxygen in the ambient air. Also, the film prevents the impurities from being nitrided by nitrogen in the ambient air.

It is most preferred that Top Rinse (brand name) of OKUNO SEIYAKU KOGYO KABUSHIKI KAISHA be used as the metal surface treatment agent. More specifically, it is preferred that the product be used as an aqueous solution of 1 to 50 weight percent. If the concentration of the product is less than one weight percent, the antioxidant effect on the surface of the silver plating layer 14 becomes insufficient. In contrast, if the concentration of the product exceeds 50 weight percent, the color of the surface of the silver plating layer 14 turns opaque.

After the silver mirror reaction posttreatment substep S45 is completed, a washing substep S46 is conducted. In S46, the surface of the silver plating layer 14 is washed with ion exchange water or distilled water. Subsequently, in a water blowing substep S47, water is blown by air and is removed from the surface of the silver plating layer 14. Next, a microcrack forming substep (an MC forming substep) S48 is conducted to form microcracks in the silver plating layer 14. In the MC forming substep S48, a cold heat treatment or an ultrasonic wave treatment is performed.

In the cold heat treatment, a treatment cycle is defined by rapid cooling of the silver plating layer 14 followed by rapid heating of the silver plating layer 14. The treatment cycle is repeated a plurality of times to form the microcracks in the silver plating layer 14. In this treatment, it is preferred that the silver plating layer 14 be cooled to −20 degrees Celsius or lower and then be heated to 60 degrees Celsius or higher. Further, it is more preferred that the silver plating layer 14 be heated to 80 degrees Celsius or higher. The cooling of each treatment cycle is performed by, for example, maintaining the silver plating layer 14, together with the base 12, in a cold insulator at −20 degrees Celsius or lower for approximately 20 minutes or exposing the entire surface of the silver plating layer 14 to cold air at −20 degrees Celsius or lower for approximately 20 minutes. In addition, it is preferred that about three treatment cycles be performed to obtain an appropriate number of microcracks efficiently.

During the cold heat treatment, the silver plating layer 14 is repeatedly exposed to a temperature change between −20 degrees Celsius or lower and 60 degrees Celsius or higher. This forms numerous crystalline interfaces 17 in the silver plating layer 14, as observed microscopically, without causing a visible change in the silver plating layer 14. On the other hand, if the ultrasonic wave treatment is performed in S48, the surface of the silver plating layer 14 is exposed to ultrasonic waves for approximately ten minutes. Like the cold heat treatment, the ultrasonic wave treatment forms numerous crystalline interfaces 17 in the silver plating layer 14, as observed microscopically, without causing a visible change in the silver plating layer 14.

After the MC forming substep S48 is completed, a topcoat forming step (a TC forming step) S50 may follow immediately. However, it is preferred that a microcrack posttreatment substep (an MC posttreatment substep) S49 be performed after the substep S48. It is preferred that an ultra-fine particle applying stage or a corrosion proof film forming stage be performed in the MC posttreatment substep S49. In the ultra-fine particle applying stage, a solution in which ultra-fine particles of an inorganic oxide are dispersed is applied to the surface of the silver plating layer 14. In the corrosion proof film forming stage, a corrosion proof film is formed on the surface of the silver plating layer 14. Alternatively, the ultra-fine particle applying stage and the corrosion proof film forming stage may be combined and performed in a certain order. This further improves the corrosion proof effect on the silver plating layer 14.

More specifically, the ultra-fine particle dispersed solution used in the ultra-fine particle applying stage contains ultra-fine particles of an inorganic oxide with a particle size of nanometer order. Further, it is preferred that the solvent of the ultra-fine particle dispersed solution be removed from the surface of the silver plating surface 14 to dry the surface. Accordingly, the surface of the silver plating layer 14 is coated with the ultra-fine particles, and each of the crystalline interfaces 17 is filled with the particles. The inorganic oxide includes aluminum oxide ($Al_2O_3$), titanium oxide ($TiO_2$), zirconium oxide ($ZrO_2$), silicium oxide ($SiO_2$), iron oxide ($Fe_2O_3$), zinc oxide ($ZnO$), cerium oxide ($CeO_2$), and yttrium oxide ($Y_2O_3$). However, since aluminum oxide is easily available and is inexpensive, it is preferred that the substance be used as the inorganic oxide. Further, the ultra-fine particles of the inorganic oxide need to have an average particle size of nanometer order such that the particles are sufficiently dispersed in water. It is preferred that commercially available particles with an average particle size of 10 to 40 nanometers be used as the ultra-fine particles of the inorganic oxide.

In the corrosion proof film forming stage, a metal surface treatment agent is applied to the surface of the silver plating layer 14 or the surface of the silver plating layer 14 is immersed in the agent, thus forming a thin corrosion proof film on the surface of the silver plating layer 14. It is preferred that the treated surface of the silver plating layer 14 be washed with ion exchange water or distilled water and then be dried. The metal surface treatment agent is the same as the one used in the antioxidant film forming stage of the silver mirror reaction posttreatment substep S45. That is, as in the antioxidant film forming stage, the treatment agent forms a highly water-repellent antioxidant film on the surface of the silver plating layer 14. This physically inhibits the exposure of the surface of the silver plating layer 14 to chloride ions. The antioxidant film thus functions as a corrosion proof film that prevents the surface of the silver plating layer 14 from being corroded by the chloride ions.

Afterward, the TC forming step S50 is performed to form the topcoat layer 15 on the surface of the silver plating layer 14 using a topcoat agent. The step S50 includes a topcoat agent applying substep S51 followed by a drying substep S52. In the substep S51, the topcoat agent is applied uniformly to the surface of the silver plating layer 14. The surface of the silver plating layer 14 is then dried at approximately 70 degrees Celsius for about 60 minutes in the drying substep S52. The topcoat layer 15 is thus completed.

As fabricated by the above-described method, the plated product 11 includes the basecoat layer 13, the silver plating layer 14, and the topcoat layer 15 that are formed on the design surface of the base 12 in this order. As described, although the numerous crystalline interfaces 17 are formed in the silver plating layer 14, as observed microscopically, the crystalline interfaces 17 are invisible. Thus, the surface of the plated product 11 is visible as an optimally shining silver mirror surface. Further, no impurities are caught between the silver plating layer 14 and the topcoat layer 15 or the impurities are physically prevented from being naturally oxidized. This suppresses yellowish discoloration of the design surface of the plated product 11. Accordingly, a white reflected light is visible on the design surface of the plated product 11, and the appearance of the product 11 is improved.

If a chloride ion enters the silver plating layer 14 via the topcoat layer 15, one or more metal particles 16 may be corroded as observed microscopically. However, the corrosion of these metal particles 16 remains invisible, thus maintaining the appearance of the plated product 11. Further, the crystalline interfaces 17, which are formed along the sides of each of the metal particles 16, significantly suppress further corrosion of the metal particles 16, thus delaying development of the corrosion. In addition, even if the corrosion of the metal particles 16 is developed, the corrosion forms only a microscopic mark and remains invisible. This prevents the appearance of the silver plate product 11 from being hampered by the corrosion.

Thus, if the plated product 11 is exposed to salt water for a relatively long time, the appearance of the product 11 is hardly hampered. Also, the visible appearance of the plated product 11 is maintained when subjected to anti-corrosion resistance tests or anti-weather resistance tests, such as various salt water spray tests and CASS Test as defined by JIS. The plated product 11 thus easily passes these tests. In addition, the plated product 11 maintains its visible appearance even if the product 11 is exposed to ultraviolet rays for a relatively long time or if the base 12 is deformed.

The illustrated embodiment of the present invention has the following effects.

In the method for fabricating the plated product 11 according to the present invention, the basecoat layer 13 and the silver plating layer 14 are first formed on the surface of the base 12. Subsequently, the silver plating layer 14 is subjected to the cold heat treatment or the ultrasonic wave treatment to form the microcracks in the silver plating layer 14. Afterwards, the topcoat layer 15 is formed on the treated surface of the silver plating layer 14. Accordingly, the crystalline interfaces 17, which are formed around each of the microcracks, efficiently suppress development of corrosion in the silver plating layer 14. This prevents the appearance of the silver plating product 11 from being hampered by the corrosion. Also, the plated product 11 easily passes various anti-corrosion resistance tests.

Particularly, the appearance maintaining effect of the plated product 11 is pronounced when the product 11 is plated with silver. More specifically, if a plated product with a metal plating layer formed of poorly corrosion-resistant material, such as silver, is fabricated by a conventional method, the product may not pass an anti-corrosion resistance test, and the appearance of the product may be significantly hampered over time. This makes it difficult to fabricate a plated product using the poorly corrosion-resistant metal, or silver. However, since the plated product 11 of the present invention includes the microcracks formed in the silver plating layer 14, the visible appearance of the plated product 11 is maintained even when corrosion is microscopically observed in the silver plating layer 14. Accordingly, the method of the present invention makes it possible to fabricate a high-quality plated product using a desired metal, regardless of the level of anti-corrosion resistance.

The MC forming substep S48 is easily completed by repeating the treatment cycle of the rapid cooling of the silver plating layer 14 to −20 degrees Celsius or lower followed by the rapid heating of the silver plating layer 14 to 60 degrees Celsius or higher. That is, the substep S48 makes it possible to readily form an appropriate number of microcracks with appropriate dimensions that are regularly aligned in the silver plating layer 14.

As described, if the ultra-fine particle applying stage is performed in the MC posttreatment substep S49, the ultra-fine particles of the inorganic oxide in water is applied to the surface of the silver plating layer 14. This efficiently suppresses corrosion of the silver plating layer 14 and, in case the corrosion occurs, efficiently stops development of the corrosion in the silver plating layer 14. Further, if the corrosion proof film forming stage is performed in the substep S49, the corrosion proof film is formed on the surface of the silver plating layer 14. This efficiently suppresses corrosion of the silver plating layer 14 and, in case the corrosion occurs, efficiently stops development of the corrosion in the silver plating layer 14. In addition, a general type may be used as the metal surface treatment agent in the corrosion proof film forming stage. That is, the metal surface treatment agent is readily available and inexpensive. Also, since the ultra-fine particle applying stage and the corrosion proof film forming stage are easy to conduct, work efficiency is maintained.

As described, the topcoat layer 15 is applied to the surface of the silver plating layer 14 using the topcoat agent that contains the chlorine type trapping agent for trapping chloride ions. This improves the effect of suppressing corrosion of the silver plating layer 14 and development of the corrosion in the silver plating layer 14.

The following is examples of the illustrated embodiment and their comparative examples.

EXAMPLE 1

First, the base 12 with a square plate shape was formed of ABS through injection molding. The pretreatment substep S31 was then completed by spraying isopropanol on the surface (the design surface) of the base 12. Subsequently, in the basecoat agent applying substep S32, B-3 (brand name, acrylic urethane coating materials) of OHASHI KAGAKU KOGYO KABUSHIKI KAISHA was sprayed on the design surface of the base 12 as a basecoat agent. The drying substep S33 was then performed in a drying furnace at 80 degrees Celsius for 60 minutes. The basecoat layer 13 with a uniform thickness of approximately 20 micrometers was thus formed on the design surface of the base 12. Afterwards, an undercoat agent (U-1 (brand name) of OHASHI KAGAKU KOGYO KABUSHIKI KAISHA) was sprayed on the surface of the basecoat layer 13 and was then dried to form an undercoat layer.

Further, a solution that contained three weight percent of stannic chloride and one weight percent of hydrochloric acid was sprayed on the surface of the undercoat layer, thus completing the silver mirror reaction pretreatment substep S41. The surface of the undercoat layer was then washed by spraying ion exchange water with electric conductivity of 3 $\mu$S/cm or lower on the surface of the undercoat layer to complete the washing substep S42. Subsequently, in the silver mirror reaction coating substep S43, Tollens reagent and glyoxal were sprayed on the surface of the undercoat layer using a double-headed spray gun (RG-2 (brand name) of ANESUTO IWATA KABUSHIKI KAISHA). The silver plating layer 14 with a uniform thickness of approximately 1000 Angstrom was then formed on the surface of the undercoat layer. Afterwards, the surface of the silver plating layer 14 was washed by spraying ion exchange water on the surface of the silver plating layer 14, thus completing the washing substep S44.

Next, in the silver mirror reaction posttreatment substep S45, a metal surface treatment agent (a 10 weight percent aqueous solution of Top Rinse (band name) of OKUNO SEIYAKU KOGYO KABUSHIKI KAISHA) was sprayed on the surface of the silver plating layer 14. The surface of the silver plating layer 14 was then washed by spraying ion exchange water on the surface of the silver plating layer 14, thus completing the washing substep S46. Subsequently, in the water blowing substep S47, compressed air was blown (an air blow was produced) to the surface of the silver plating layer 14. At this stage, the plated product 11 had the base 12, the basecoat layer 13, the undercoat layer, and the silver plating layer 14. The MC forming substep S48 was then conducted by repeating three cycles of cold heat treatment. Each treatment cycle included cooling of the plated product 11 in a cold insulator at −20 degrees Celsius for 10 minutes followed by heating of the plated product 11 in a drying (heating) furnace at 80 degrees Celsius for 20 minutes.

Finally, a topcoat agent (T-1 (brand name) of OHASHI KAGAKU KOGYO KABUSHIKI KAISHA) was sprayed on the surface of the silver plating layer 14, thus completing the topcoat agent applying substep S51. The plated product 11 was then subjected to the drying substep S52 in a drying furnace at 70 degrees Celsius for 60 minutes. The topcoat layer 15 with a uniform thickness of approximately 20 micrometers was thus formed on the surface of the silver plating layer 14. The obtained plated product 11 had the base 12 on which the basecoat layer 13, the undercoat layer, the silver plating layer 14, and the topcoat layer 15 were formed.

COMPARATIVE EXAMPLE 1

Comparative Example 1 was produced in the same manner as Example 1, except that the MC forming substep S48 was not performed and the product 11 was dried in a drying furnace at 50 degrees Celsius for 30 minutes after the water blowing substep S47. The obtained plated product had the base 12 on which the basecoat layer 13, the undercoat layer, the silver plating layer 14, and the topcoat layer 15 were formed.

EXAMPLE 2

In Example 2, U-2 (brand name, bisphenol type epoxy coating materials) of OHASHI KAGAKU KOGYO KABUSHIKI KAISHA was used as the undercoat agent, and PTC-02 (brand name, silicone acrylic coating materials) of FUJIKURA KASEI KABUSHIKI KAISHA was used as the topcoat agent. Further, the MC posttreatment substep S49 was performed between the MC forming substep S48 and the topcoat agent applying substep S51. In the MC posttreatment substep S49, ultra-fine particles of aluminum oxide (Nanomaterial (brand name) of NANOTECH KABUSHIKI KAISHA) dispersed in acescent water was first sprayed on the surface of the silver plating layer 14. The product 11 was then dried in a drying furnace at 50 degrees Celsius for 30 minutes. The remainder of Example 2 was performed in the same manner as Example 1. The obtained plated product 11 had the base 12 on which the basecoat layer 13, the undercoat layer, the silver plating layer 14, and the topcoat layer 15 were formed.

COMPARATIVE EXAMPLE 2

Comparative Example 2 was performed in the same manner as Example 2, except that the MC forming substep S48 and the MC posttreatment substep S49 were omitted. The obtained plated product had the base 12 on which the basecoat layer 13, the undercoat layer, the silver plating layer 14, and the topcoat layer 15 were formed.

Anti-Corrosion Resistance Acceleration Tests

Anti-corrosion resistance acceleration tests were performed on the plated products 11 of Examples 1, 2 and the plated products of Comparative Examples 1, 2 in accordance with a method of CASS Test. More specifically, a 5 weight percent aqueous solution of sodium chloride that contained a small quantity of acetic acid and cupric chloride were sprayed in a test apparatus while maintaining the temperature of the solution at 49 degrees Celsius. Each plated product was placed still in the test apparatus to visually evaluate development of corrosion and opaque discoloration of the silver mirror surface. As a result, the corrosion development and the discoloration of the silver mirror surface were both observed in the plated product of each comparative example, as time elapsed. However, neither corrosion nor discoloration was visually observed in the plated products 11 of Examples 1, 2. Further, this difference between Examples and Comparative Examples gradually became more pronounced as time elapsed.

It should be apparent to those skilled in the art that the present invention may be embodied in many other specific forms without departing from the sprit or scope of the invention. Particularly, it should be understood that the invention may be embodied in the following forms.

The silver mirror reaction posttreatment substep S45 may be omitted.

The silver plating layer 14 does not necessarily have to be formed by a chemical plating method (electroless deposition). However, the silver plating layer 14 may be formed by an electric plating method, a roll leaf hot stamping method, or a vacuum deposition method. If this is the case, a microcrack forming substep identical with the substep S48 need be performed after the silver plating layer 14 is formed.

When forming a plated product using metal other than silver, or, particularly, a relatively poorly corrosion-resistant metal, a microcrack forming substep identical with the substep S48 may be performed after a metal plating layer is formed.

The material of the base 12 includes molded bodies of rubber, glass, ceramics, wood, or paper with various shapes, as long as the basecoat layer 13 can be formed directly or indirectly on the surface of the base 12. Further, the base 12 may be formed of thermoplastic resin other than the one used in the illustrated embodiment or thermally hardened resin. In addition, the base may be formed of hard or soft synthetic resin.

The present examples and embodiments are to be considered as illustrative and not restrictive and the invention is not to be limited to the details given herein, but may be modified within the scope and equivalence of the appended claims.

What is claimed is:

1. A method for fabricating a plated product with a basecoat layer, a metal plating layer, and a topcoat layer that are formed on a surface of a base, the method comprising the steps of:

forming the basecoat layer and the metal plating layeron the surface of the base;

forming a microcrack in the metal plating layer by subjecting the metal plating layer to a cold heat treatment after the formation of the basecoat layer and the metal plating layer, wherein the cold heat treatment is performed by repeating a plurality of treatment cycles, and each of the treatment cycles includes cooling the metal plating layer to −20 degrees Celsius or lower and then heating the metal plating layer to 60 degrees Celsius or higher; and forming the topcoat layer on a surface of the metal plating layer.

2. A method for fabricating a plated product with a basecoat layer, a metal plating layer, and a topcoat layer that are formed on a surface of a base, the method comprising the steps of:

forming the basecoat layer and the metal plating layer on the surface of the base;

forming a microcrack in the metal plating layer by subjecting the metal plating layer to a cold heat treatment or a supersonic wave treatment after the formation of the basecoat layer and the metal plating layer;

applying a solution in which ultra-fine particles of an inorganic oxide are dispersed on the surface of the metal plating layer after the formation of the microcrack in the metal plating layer; and forming the topcoat layer on a surface of the metal plating layer.

3. A method for fabricating a plated product with a basecoat layer, a metal plating layer, and a topcoat layer that are formed on a surface of a base, wherein the metal plating layer is a silver plating layer formed by a chemical plating method that uses silver mirror reaction, the method comprising the steps of:

forming the basecoat layer and the metal plating layer on the surface of the base;

forming a microcrack in the metal plating layer by subjecting the metal plating layer to a cold heat treatment or a supersonic wave treatment after the formation of the basecoat layer and the metal plating layer; and forming the topcoat layer on a surface of the metal plating layer.

4. The method according to claim 3, further comprising the step of forming a corrosion proof film on the surface of the metal plating layer after the formation of the microcrack in the metal plating layer.

5. The method according to claim 4, wherein the corrosion proof film forming step includes coating the surface of the metal plating layer with a metal surface treatment agent.

6. The method according to claim 3, wherein the topcoat layer is formed of a topcoat agent that contains a trapping agent for trapping a chloride ion.

7. The method according to claim 3, wherein the base is formed of synthetic resin.

8. A method for fabricating a plated product with a basecoat layer, a metal plating layer, and a topcoat layer that are formed on a surface of a base formed of synthetic resin, the method comprising the steps of:

forming the basecoat layer on the surface of the base, wherein the basecoat layer is obtained by applying a basecoat agent to the surface of the base or immersing the surface of the base in the basecoat agent and then drying the basecoat agent on the surface of the base;

forming the metal plating layer on the basecoat layer, wherein the metal plating layer is obtained by a chemical silver plating method;

forming a microcrack in the metal plating layer by subjecting the metal plating layer to a cold heat treatment or an ultrasonic wave treatment; and forming the topcoat layer on the surface of the metal plating layer.

9. The method according to claim 8, wherein the cold heat treatment is performed by repeating a plurality of treatment cycles, and each of the treatment cycles includes cooling the metal plating layer to −20 degrees Celsius or lower and then heating the metal plating layer to 60 degrees Celsius or higher.

10. The method according to claim 8, further comprising the step of applying a solution in which ultra-fine particles of an inorganic oxide are dispersed to the surface of the metal plating layer after the formation of the microcrack in the metal plating layer.

11. The method according to claim 8, further comprising the step of forming a corrosion proof film on the surface of the metal plating layer after the formation of the microcrack in the metal plating layer.

12. The method a cording to claim 11, wherein the corrosion proof film forming step includes coating the surface of the metal plating layer with a metal surface treatment agent.

* * * * *